US011401137B2

(12) United States Patent
Ozarski

(10) Patent No.: US 11,401,137 B2
(45) Date of Patent: Aug. 2, 2022

(54) OVERHEAD STORAGE DEVICE

(71) Applicant: Robert Ozarski, Poway, CA (US)

(72) Inventor: Robert Ozarski, Poway, CA (US)

( * ) Notice: Subject to any disclaimer, the term of this patent is extended or adjusted under 35 U.S.C. 154(b) by 102 days.

(21) Appl. No.: 14/544,511

(22) Filed: Jan. 14, 2015

(65) Prior Publication Data

US 2020/0354204 A1 Nov. 12, 2020

(51) Int. Cl.
*B66D 3/04* (2006.01)
*B66D 1/16* (2006.01)

(52) U.S. Cl.
CPC ..... *B66D 3/04* (2013.01); *B66D 1/16* (2013.01)

(58) Field of Classification Search
CPC .... B66D 3/04; B66D 1/12; B66D 1/16; B66C 19/00; B25J 9/026; B66F 7/02
See application file for complete search history.

(56) References Cited

U.S. PATENT DOCUMENTS

2012/0068133 A1* 3/2012 Ozarski ..... B62H 3/12 254/364

* cited by examiner

*Primary Examiner* — Joel D Crandall
(74) *Attorney, Agent, or Firm* — John R. Ross; John R. Ross, III

(57) ABSTRACT

An overhead storage device comprising a cable pulley; a constant torque spring unit attached to the cable pulley and adapted to apply an approximately constant torque to the cable pulley; a cable partially wound around the cable pulley and having an attachment mechanism at one end of the cable; and a locking mechanism; comprising a pawl, a release cord attached the pawl and a ratchet unit; adapted to permit the attachment mechanism and an attached load to be lowered and locked at any desired position within the range of the device. The device is particularly suited for storing items, such as bicycles, golf clubs and yard equipment that are commonly stored in garages.

4 Claims, 11 Drawing Sheets

OVERHEAD STORAGE DEVICE

CROSS REFERENCE TO RELATED APPLICATIONS

This application is a continuation in part of U.S. patent application Ser. No. 13/235,362 filed Sep. 16, 2011, which is incorporated by reference herein.

FIELD OF THE INVENTION

The present invention relates to storage devices and in particular to overhead storage devices.

BACKGROUND OF THE INVENTION

Most families in the United States own one or more bicycles. Only a small portion of the populations regularly rides the bicycles. Most bicycles in the United States are in storage, often with flat tires and rusty chains. Many bicycle storage devices have been proposed. Many of these devices seek to store the bicycles in spaces not needed for other uses, such as up above floor spaces, for example, by hanging the bicycle from a ceiling in a garage, above normal automobile spaces. Some prior art patents covering bicycle storage include the following U.S. Pat. Nos. 3,872,972, 6,161,207, 3,907,113 and 5,183,162. U.S. Pat. No. 3,872,972 includes a rack for hanging a bicycle above the floor and a counterweight to ease the effort associated with raising the bicycle.

Prior art U.S. Pat. No. 7,370,843 discloses a retractable load support system a constant torque spring for providing an approximately constant torque to a spool arranged to lift a load like a bicycle for overhead storage and a gerotor "for dampening the raising of [the load] in a relatively fast manner which can damage the [load or the support system]. A gerotor is a special fluid pump and in this system the fluid was merely circled to dissipate energy so as to slow down the lifting of the load. The gerotor adds considerably to the cost of the system.

Constant torque springs have been around for a long time with one of their initial applications being as early as the $15^{th}$ century as the mainspring of wind up clocks. The oldest surviving clock powered by a mainspring is the Burgunderuhr (Burgundy Clock), an ornate, gilt chamber clock, currently at the *Germanisches Nationalmuseum* in Nurnberg, whose iconography suggests that it was made around 1430 for Philippe the Good, Duke of Burgundy.

What is needed is a better overhead storage device.

SUMMARY OF THE INVENTION

The present invention provides an overhead storage device. The device is particularly suited for storing items commonly stored in a garage, such as bicycles, golf clubs, and yard equipment, which occupy floor space and often exclude the ability to park an automobile in the garage. In particular the device includes a mechanism for hoisting the object to be stored such as a bicycle above floor level. The device includes a cable with an attachment mechanism at one end of the cable. The cable is partially wound on a spool. A constant torque spring applies an approximately constant torque to the spool. This approximately constant torque continuously causes the cable, unless restrained, to be further wound on the spool. The device includes a special locking mechanism which allows the attachment mechanism and an attached load to be lowered and locked at any desired position within the range of the device. In preferred embodiments the locking mechanism includes a pawl and ratchet unit adapted to restrain any lifting of the load unless a release cord attached to a release arm is pulled which is connected to the pawl by a torsion spring. An alternative to the manual release is the use of a WiFi operated microcontroller which is controlled through the WiFi connection to a smart phone or a WiFi network device. The action of the release arm causes a rotational force to be applied to the pawl which initiates step one of a two step release process. The second step requires a downward force to be applied to the load such that it descends slightly. This second action causes the pawl to unlock from the ratchet allowing the load to ascend. This two step feature prevents an accidental release of the locking mechanism. Such an accidental release could damage the load and/or the storage device.

Bicycles provide a unique challenge to attach to a lifting storage device, as they have a large variety of shapes, sizes and angles of their cross bars. Modern bikes are very expensive with some costing upwards of $10,000 and composed of materials ranging from bamboo to carbon fiber. The invention describes an attachment device which accommodates this wide range to hold them securely, without causing any damage. In particular the load attachment device must hold the bicycle along its cross bar which may be angled significantly without sliding along it as the bicycle is raised.

Preferred embodiments of the present invention include a cable pulley; a constant torque spring unit attached to the cable pulley and adapted to apply an approximately constant torque to the cable pulley; a cable partially wound around the cable pulley and having an attachment mechanism at one end of the cable; and a locking mechanism adapted to permit the attachment mechanism and an attached load to be lowered and locked at any desired position within the range of the device; wherein the approximately constant torque applied by the constant torque spring continuously causes the cable, unless restrained, to be further wound on the cable pulley. Applicant's use of the phrase "approximately constant torque" of a constant torque spring is meant to refer to torque that varies by less than plus or minus 10 percent over the range of the spring.

A preferred locking mechanism is a pawl and ratchet unit which preferably includes a release cord connected to the pawl such that the pawl and ratchet unit restrains rotation of the spool unless said release cord has been pulled downward with a downward force and the load is simultaneously pushed slightly downward. Preferred constant torque spring units include a constant torque spring, an output spool, and a storage spool, wherein said spring is wrapped around said output spool and said storage spool in reverse directions so as to create a nearly constant torque on said output spool and said cable pulley. Preferred embodiments also include a holding feature for holding said locking mechanism in an unlocked position while said cable is wound around said cable pulley and while a load is raised and load release feature for allowing the raising and lowering of a load.

Preferred embodiments may also include a centrifugal clutch for stopping rotation of said cable pulley during rapid acceleration of said cable pulley and in some applications the release cord is a loop and can be used as a means of raising the lift cable when it is not in use to lift a load. Features are also provided for storing bicycles is horizontally as well as vertical. A special bicycle attachment feature is described which includes a rubber coated strap designed to minimize any damage to expensive bicycles in the course of storage.

DETAILED DESCRIPTION OF PREFERRED EMBODIMENTS

Figure 1:
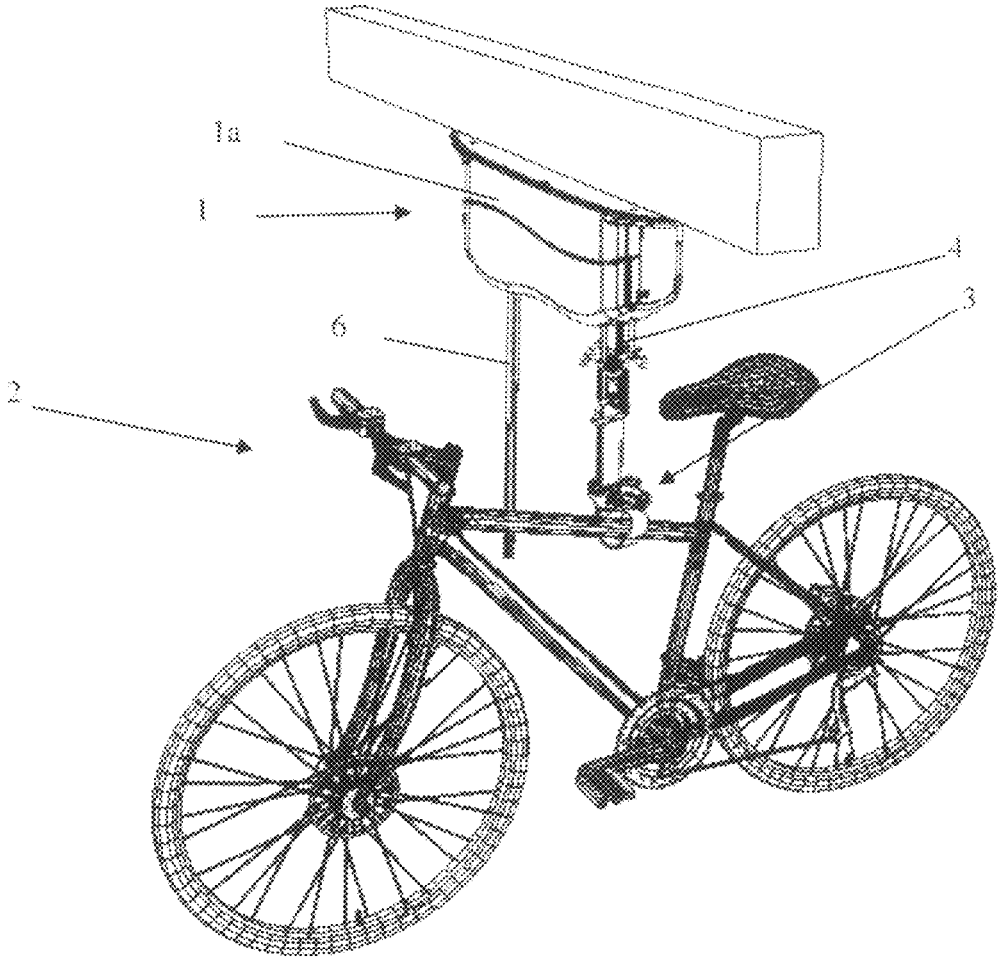
FIGS. 1-2 show a preferred embodiment of the present invention.
Figure 2:
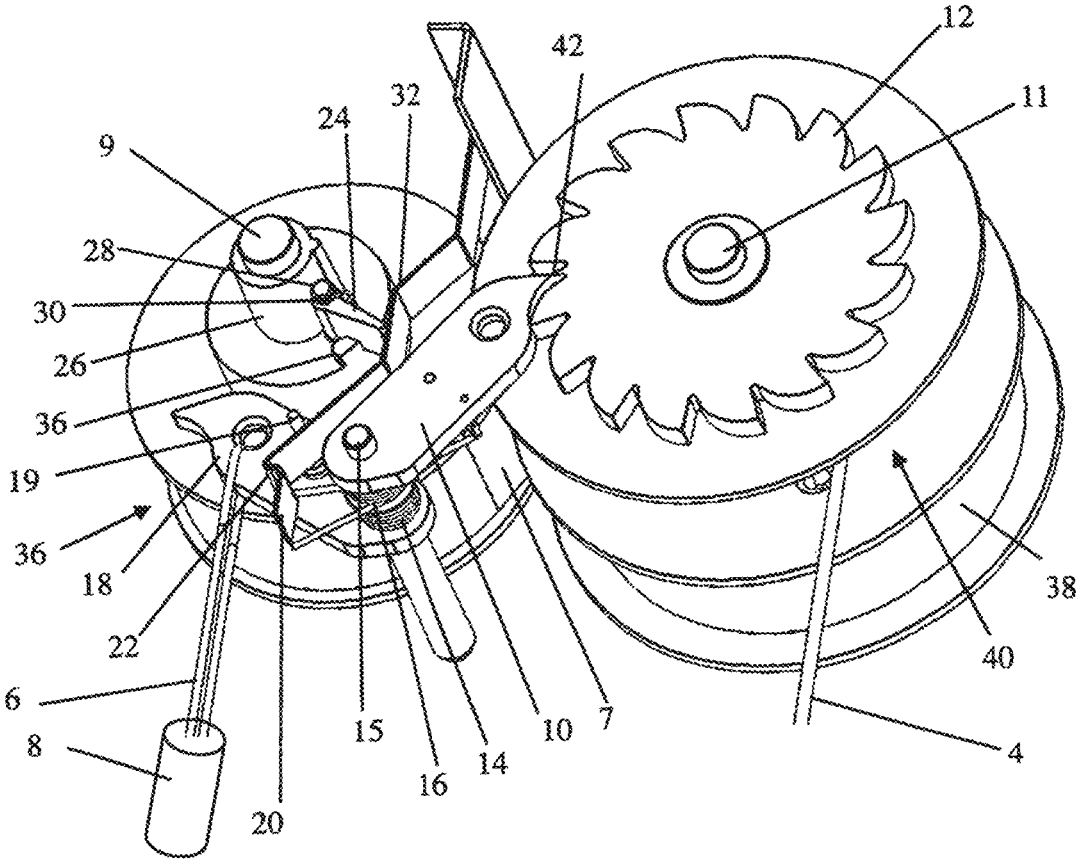

FIG. 1 shows a bicycle storage device 1, which allows a bicycle to be lifted by a constant torque spring mechanism and pulley system of FIG. 2, from its standing position on the ground to a position at the top of the lifting device's travel for storage. A bicycle 2 or other load is attached by a load attachment device 3, as shown in FIG. 1 to a lift cable 4 suspended by the device's cable pulley 40 of FIG. 2 which is mounted in the containment and support case 1A of FIG. 1, through a shaft 11, shown in FIG. 2. A constant torque spring 7, supplies a force slightly greater than the weight of the object load (bicycle), such that the load object will rise until the maximum lift height is reached or the object reaches the ceiling. A preferred constant torque spring is available from Vulcan Springs, Inc. with offices in Telford, Pa. The object load (bicycle) is lowered by manually applying a small amount of downward force, by pulling downward on the object load attached to the load attachment device 3 of FIG. 1. As the object load 2 (a bicycle) of FIG. 1 is lowered a pawl 10 will rotate counterclockwise and ratchet 12 will rotate clockwise, shown in FIG. 2 allowing the bicycle to descend by rotating but when the downward pull is stopped the load object will tend to rise due to the torque applied to it by the constant torque spring 7, turning the cable pulley 40 in a counterclockwise direction. This will cause the pawl 10 to engage the ratchet 12 due to the clockwise force applied to it by torsion spring 16 mounted around axel 15 with one end attached to pawl 10 and the other held by the containment and support case. Thereby preventing the cable pulley 40 from turning and the load from rising. The pawl 10 is positioned such that an arc from its pivot position with a radius equal to the distance from the pivot to the pawl apex 42 will intersect the circumference of the ratchet teeth, root circle. The position at which the pawl 10 stops the rotation of the ratchet 12 is where the lower intersection of the two circles occurs. This action allows the load to be stopped at any point in its travel, when the downward force applied by the user is stopped. With the pawl 10 engaged into the ratchet 12, the object load, such as a bicycle, can be removed from the load attachment device 3 of FIG. 1. The load attachment device 3 remains at whatever height above the floor it was positioned at. The lift cable 4 is wound around the cable pulley 40, as shown in FIG. 2, to which the lift cable 4 is attached and connected by a shaft to the output spool 38 of the constant torque spring 7. The constant torque spring mechanism, is comprised of the containment and support case 1A of FIG. 1 and a constant torque spring 7 of FIG. 2, which is wound around two spools. The output spool 38 and the storage spool 36, as shown in FIG. 2, which are supported by their respective axle shafts 11 and 9. A portion of the constant torque spring is coiled about the output spool 38 and a portion about the storage spool 36 in the reverse rotation. This reversal of the winding from the output spool 38 to the storage spool 36 creates a nearly constant torque (+/−10%) on the output spool 38, which is transferred to the cable pulley 40 by its connection to the output pulley 38. The torque transferred to the cable pulley 40 generates a force which tends to wind the lift cable 4 about the cable pulley 40 and thereby lift the load of the attached bicycle or other object, within the lifting limits of the torque, which is supplied by the constant torque spring 7.

The constant torque spring 7 is designed such that the torque it generates in combination with the radius of the cable spool 2 produces a force, which is slightly greater than the weight of the intended load (bicycle for example) to be lifted. The maximum lifting capability is determined by the proper choice of the spring parameters, spool diameters and the cable pulley's diameter. For a given constant torque spring, the lifting torque and thereby the load lifting capability of the device can be adjusted to suit the intended load by adjusting the diameter of the cable pulley 40. This can be accomplished in a variety of ways, for example by replacing the spool with a suitable diameter for the load, by adding or removing a cylindrical sleeve to the base cable pulley 40 to increase its diameter, or by winding a material about the spool upon which the lifting cable rides on top of, thereby increasing the effective diameter as experienced by the lifting cable 4. The spring mechanism provides a nearly constant torque (+/−10%) independent of the number of turns on the output and storage spools; this creates a nearly constant force on the lift cable, which is always tending to lift the object load. To lower the load a downward force is applied by the user which overcomes the constant torque spring force applied to the cable pulley 40 such that it unwinds the lift cable 4, causing the load to descend. This will wind further turns of the constant torque spring 7 onto the output spool 38 as the load is lowered. In normal operation the constant torque spring 7 is coiled about the storage spool 36 with only a few turns about the output spool 38. As the load is lowered, from its uppermost position, it winds an increasing portion of the constant torque spring 7 about the output spool 38, which supplies torque to the cable pulley 40 and thereby provides a force to resist the weight of the object load, attached to the lift cable 4, in affect counter balancing it. During lowering of the load, the pawl 10, is not engaged into the ratchet 12, attached to the cable pulley 40, but rides along the top edge of the teeth of ratchet 12 as it rotates clockwise. When the load reaches the desired height and the downward force applied by the user is released, the pawl 10 and the cable spool 40 will tend to rotate counter clockwise due to the force of constant torque spring 7. This will cause a tooth of the ratchet 12 to engage into pawl 10 preventing it from turning counter clockwise and thereby any upward travel of the lift cable 4. This locking action allows the load to be lowered to any desired height and removed from the load attachment device 3, shown in FIG. 1, at any position along its travel.

In order for the device to lift a load, the pawl 10 must be disengaged from the ratchet 12 to ride on top of the teeth of ratchet 12 when lowering a load. This is accomplished in the following manner. The pawl 10 is free to rotate about axle 15. A torsion spring 16 is mounted around axel 15. One end of it is attached to pawl 10. The other end is attached to the containment and support case 1A. The torsion spring 16 tends to rotate the pawl 10 clockwise, about axle 15, thereby tending to hold it in contact with ratchet 12. A release arm 18 is also mounted on the axle 15 and is free to rotate about it. A second torsion spring 14, is mounted on axle 15. One end of spring 14, is affixed to release arm 18. The other end of spring 14 is affixed to pawl 10. The spring 14 is positioned such that when pawl 10 is engaged in ratchet 12, there is no tension due to spring 14 between the pawl 10 and the release arm 18. When release cord handle 8, is pulled downward it causes the end of spring 14, attached to release arm 18 to coil about axel 15 thereby applying tension in a counterclockwise direction to pawl 10. When pawl 10 is engaged in ratchet 4, the tension of the constant torque spring 7, causing counter clockwise tension on the ratchet 12, keeps the pawl 10 engaged in ratchet 12 preventing it from rotating out from under a tooth of ratchet 12. As release arm 18 rotates counterclockwise, due to the pulling down of release cord handle 8, the latch pin 19 affixed to pawl 10 will rotate with it. It will contact flat latch spring 20. This will cause the latch spring 20 to deflect to the right. As latch pin 19 rotates further counter clockwise, it will pass under latch point 22 of flat spring 20, which is a step in flat spring 20. As the user stops pulling on the release cord handle 8, the release arm 18 will rotate clockwise due to spring 14. The latch pin 19 will catch under the latch point 22 and prevent it from rotating clockwise further. This will hold release arm 18 in a rotated position and applying a counterclockwise force to pawl 10. Spring 14 and spring 16 are chosen such that the net torque on pawl 10 is counterclockwise, when release arm 18 is rotated and latched into latch point 22. Since the pawl 10 is engaged in the ratchet 12 and is therefore unable to rotate counter clockwise, due to the counterclockwise torque applied to the ratchet 12, by the constant torque spring 7, it will remain trapped in a tooth of ratchet 12 and the cable spool 40 will not rotate to raise the load. This condition exists as long as the force of the load attached to the lift cable 4 tending to rotate the cable spool 40 and hence the attached ratchet 12 clockwise, is less than the torque tending to rotate the ratchet 12 clockwise by the constant torque spring 7. This is the condition when a load is attached to the lift cable ready to be raised or in its stored position. In order to raise the load in addition to pulling the release cord handle 8, the pawl 10 must be disengaged from the ratchet 4. This is accomplished by first pulling the release cord handle 8 causing the latch pin 19 to be trapped under latch point 22, as described above. Thereby applying a counter clockwise torque on pawl 10 tending it to rotate counter clockwise to come out from a tooth of ratchet 12. The user then must momentarily increases the downward force of the load by exerting an additional downward force, causing the load to descend slightly and the cable spool 40 to rotate slightly by one tooth of the ratchet 12, clockwise which allows pawl 10 to disengage from ratchet 12, due to the net torque applied by springs 14 and 16 counter clockwise. The angle through which the release arm 18 has been rotated when latched is chosen such that it causes the pawl 10 to rotate sufficiently that it becomes clear of the teeth of ratchet 12 and no longer can prevent ratchet 12 from rotating counterclockwise, as long as the release arm 18 is latched by latch point 22. Under this condition the load will ascend until it is either stopped by some portion of it reaching the ceiling, the bottom of the device containment and support case or the device docking collar 86 into docking cradle 84, shown in FIG. 8. It will remain there under upward tension.

During the loads ascent, cam base 26 shown in FIG. 2, attached to storage spool 36 will rotate clockwise. The cam arm 24 is mounted about hinge pin 28 on cam base 26. A cam torsion spring 30 is also installed around pin 28, which rotates cam arm 24 clockwise against cam stop 36 which keeps it pointed in the radial direction. As the storage spool 36 and the attached cam base 26 rotates clockwise for a descending (opposite the direction of the output spool 38) load, cam 24 contacts the latch spring 20 release point 32 on each rotation. The cam spring 30 will be compressed by the contact of cam 24 with the latch spring 20 on each rotation but the spring force of spring 30 is chosen such that the cam 24 will rotate counter clockwise about pin 28 toward its base 26 and not deflect the latch spring 20, as it passes over the release point 32, in a clockwise direction. Therefore, the release pin 19 of release arm 18 remains latched in latch point 22, allowing the load to ascend, as cable 4 winds about cable spool 40. For descent the release arm 18 needs to be reset to it original unlatched position, applying no tension on pawl 10. This is accomplished as follows. When it is desired to lower the load, the user pulls downward on the load attached to the lift cable 4, overcoming the upward torque of constant torque spring 7. As the load descends cam base 26 will rotate counterclockwise. As cam 24 rotates with its base 26 counterclockwise, its tip will contact release point 32 of flat spring 20. Because cam 24 is restrained by stop point 36 from rotating clockwise about pin 28, it will push against flat spring 20 and cause it to deflect to the right, as shown in FIG. 2. As it defects to the right it will allow latch pin 19 to come out from under latch point 22. This will relieve the counterclockwise net force on pawl 10 due to springs 14 and 16 and result in a clockwise force due to spring 16 alone. This will rotate pawl 10 clockwise into ratchet 12, which it was held away from. This is the desired condition during descent such that at any point during its descent when downward force applied by the user is discontinued, the load will stop its descent and stay in the position it was released, as pawl 10 engages a tooth of ratchet 12, when the load tries to rise due to constant torque spring 7 tending to rotate ratchet 12 counterclockwise. This restores the initial condition whereby the load can be lowered and will remain at any intermediate position, whenever the force exerted by the user to lower the load is discontinued.

Figure 8:
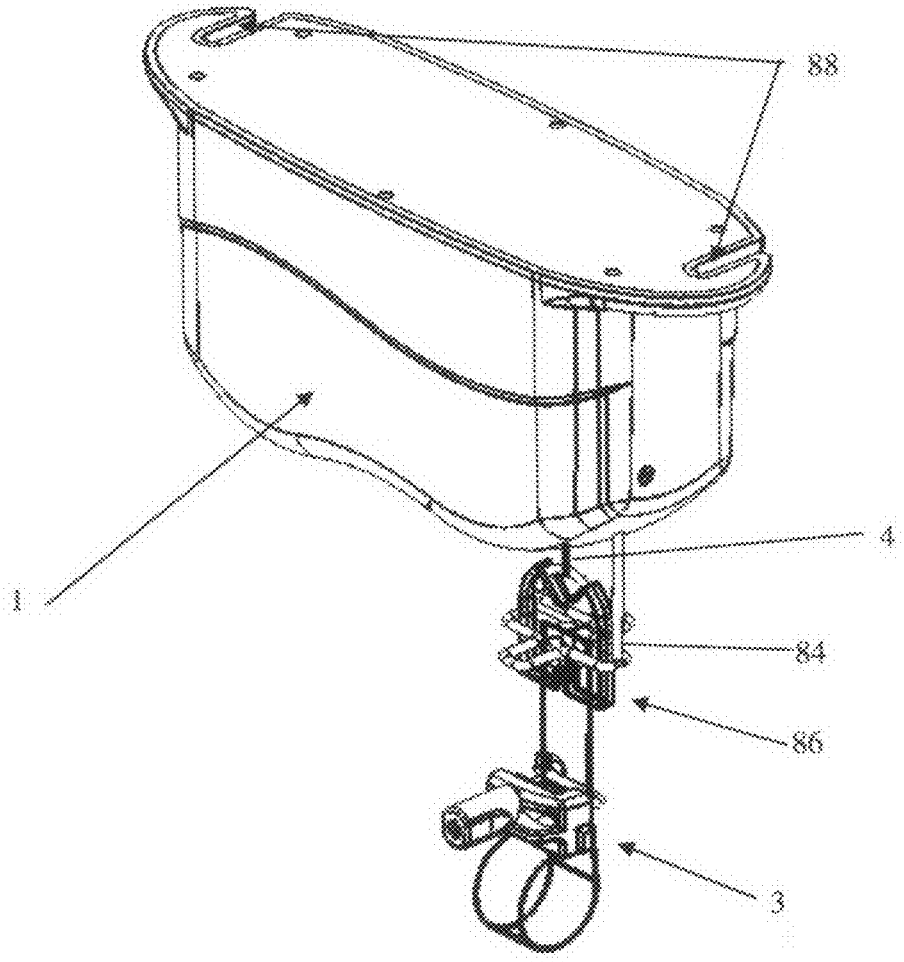
FIG. 8 shows a preferred bike load attachment device, orientation and adjustable height stop.

A feature of preferred embodiments of the storage device is its ability to be easily mounted using mounting slots 8, as shown in FIG. 8. Two lag screws are partially screwed into a ceiling joist in the position spaced apart the distance between the slots 88. The slots 88 in the containment and support case are slid over the lag bolts and tightened to complete installation.

An additional feature is the docking cradle 84, shaped like an open cross mounts into the support containment and support case and is height adjustable, as shown in FIG. 8. A connecting docking collar 86 is affixed to the bicycle attachment device 3 and the other end affixed to the lifting cable 4. The docking collar 86 is shaped to mate into a section of the docking cradle 84. When mated with the docking cradle, the docking cradle stops the load from ascending further. It also prevents the attached bicycle from rotating and keeps any portion of the bicycle from contacting the ceiling or the containment and support case 1A of FIG. 1, thereby preventing any scratching or marring of the bicycle.

The cross shape of the docking cradle 84 of FIG. 8, allows the bicycle when ascending to its stored position to be docked into either opening of the docking cradle cross. Therefore as the bicycle attached to the attachment device 3 is raised it can be oriented either parallel or perpendicular to the long axis of the containment and support case. This means that although the containment and support case 1, is necessarily mounted along the long axis of a ceiling joist, the bicycle can be oriented either parallel or perpendicular as desired for convenient storage.

An additional feature of preferred embodiments is the release cord 6 of FIG. 2 which attached to the handle 8 is a loop through release arm 18. Therefore when there is no load attached the end of the lift cable, the attachment device 3 can be hooked onto the handle 8 of the release cord 6. One side of the release cord loop can then be pulled to rotate it which will in turn raise the handle 8 and the end of the lift cable, to form a loop, such that its end is substantially moved up and out of the way when no load is attached to it. When it is desired to attach a load, the loop formed by the lift cable between the cable spool and release cable handle is pulled which brings the attachment device and handle back down, where it can be detached from the release cable handle and attached to the load.

Alternate Method of Releasing Using WiFi

Figure 3:
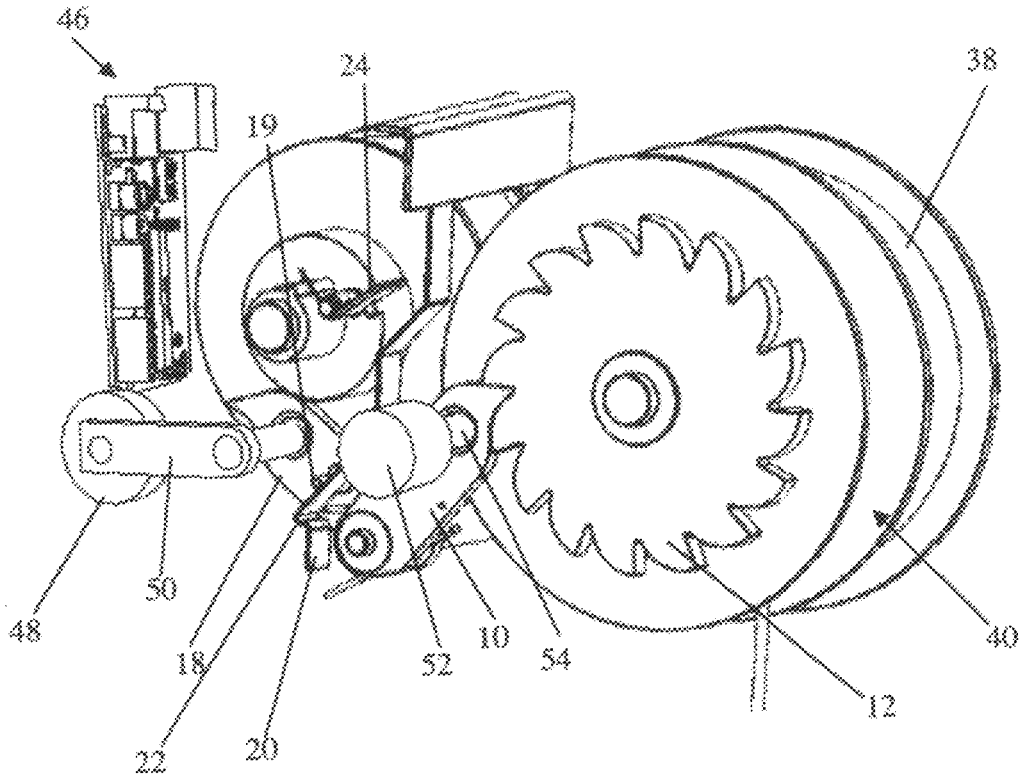
FIG. 3 show another preferred embodiment of the present invention using WiFi activation.
Figure 3:
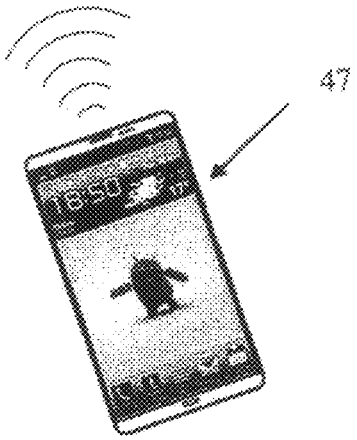

An alternate method of performing the function of the release cord 6 of FIG. 2 is shown in FIG. 3. In this method the release cord is replaced by a rotary solenoid 48. An arm 50 affixed to the solenoid 48 is connected to the release arm 18 by a rotary joint. The solenoid 48 is actuated by a WiFi controller 46, such as, an Arduino SainSmart UNO, ATmega328P and a CC3000 WiFi chip. In operation the Arduio controller 46 receives a WiFi signal from a software application running on a smart phone 47. The user selects a command in the application running on the smart phone, which sends a WiFi signal instruction to the Arduino controller 46. The primary commands are Lift, Unlock and Lock although others may be programmed for other functions, such as alerting a user, on their smart phone, if the bicycle is tampered with by someone unauthorized. When a Lift command is received by the Arduino controller, it is programmed to actuate the solenoid 48 to rotate arm 50 clockwise sufficiently to cause the latch pin 19 to be trapped under latch point 22, as occurred when the release cord 6, in FIG. 2 was used, as described previously. The solenoid actuated momentarily then deactivated but the latch pin 19 remains trapped under latch point 22. This will hold the release arm 18 rotated in a counterclockwise position. As previously described for the case where a release cord 6 of FIG. 2 was used to allow a load to be raised. As before, the user must perform a second action of applying a downward force in addition to the load to cause the load to descend slightly and pawl 10 to disengage from ratchet 12, shown in FIG. 3 and remain clear of it while release arm 18 is held rotated by latch pin 19. This then allows the constant torque spring force to cause the load to ascend, as previously described. The load will rise until some portion of the load reaches the ceiling, the docking collar or the device containment and support case 1 of FIG. 1, where it remains under tension. As the load is lowered by applying a downward force, which overcomes the spring torque applied by constant torque spring 20 of FIG. 3, it will descend. This will cause cam 24 of FIG. 3 to contact flat spring 20 of FIG. 3 causing the flat spring 22 to deflect to the right allowing latch pin 19 to disengage and both pawl 10 and release arm 18 to rotate back to their original positions due to the net force of torsion springs 14 and 16 of FIG. 2. This allows pawl 10 to be held against ratchet 12 but ride along the teeth during the clockwise rotation of load descent. The load will continue to descend as a sufficient additional force is applied to overcome the torsion spring force of spring 7. When this downward force, applied by the user, is discontinued the load will be stopped at its current position by the action of pawl 10 engaging in a tooth of ratchet 12. Descent can be resumed by continuing to exert additional downward force by the user. To reinitiate ascent of the load, the smart phone application must again be used to send a Lift command to the Arduino controller 46 to cause arm 50 to rotate clockwise and begin the latching sequence again.

To prevent an unauthorized person to access the load by lowering it a second latching solenoid 52 is affixed to the containment and support case. When a Lock commanded is issued from a users smart phone a solenoid shaft 54 extends into pawl 10. This prevents pawl 10 from rotating in any direction, which prevents ratchet 12 and cable spool 40 from rotating, preventing the load from descending or ascending. When an Unlock command is issued from the authorized smart phone, the solenoid shaft 54 will retract from pawl 10 and allow it to rotate counterclockwise as the load descends. The Unlock command is always automatically sent when a Lift command is issued. The Lock command is selected and issued by the user from their authorized smart phone to cause the solenoid to engage shaft 54 into pawl 10, when it is desired to lock the load in its raised or any intermediate position.

The authorization of a smart phone is part of the application software which allows the user to pair their smart phone with a particular device and set a password so that only their phone will cause the controller 46 to accept commands.

Centrifugal Brake

Figure 4:
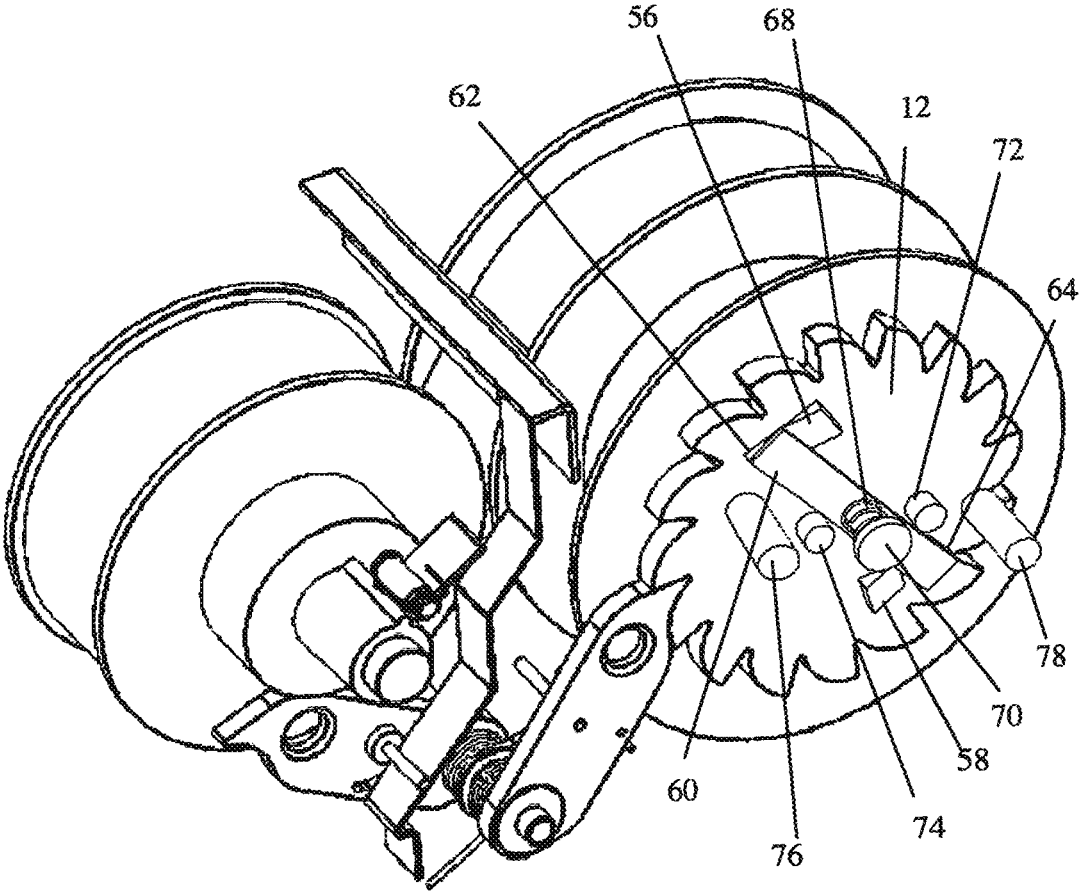
FIG. 4-5 shows another preferred embodiment of the present invention using a clutch mechanism to control the maximum rate of ascent.

The constant force spring in normal operation counter balances the weight of the load and the user moderates the speed at which it rises. However, in the event that the user does not hold onto the load to moderate its rate of rise, it can accelerate and strike the device causing it or the load to be damaged. This can also occur if the pawl 10 were to fail or somehow become disengaged from the ratchet 12 shown in FIG. 2. To prevent too rapid an ascent a centrifugal brake may be used. Under rapid acceleration the centrifugal brake, as shown in FIG. 4 would engage and stop rotation. The operation of the centrifugal brake is as follows. A rotating surface, such as a surface of ratchet 12 shown in FIG. 4, is used to mount the centrifugal brake components. The brake components consists of; tapered pads 56 and 58 affixed to press against the surface of ratchet 12, rotating arm 60, which rotates about axel 70, tapered pads 62 and 64, (which are of the opposite angle to pads 56 and 58), which are affixed to arm 62, compression spring 68, surrounding axel 70, locating pins 72, 74 and stop pins 76, 78. In normal operation rotating arm 60 which is free to rotate about axle 70 rests against locating pins 72 and 74, and is pressed toward the surface of ratchet 12 by spring 68. As ratchet 12 is turned clockwise with a rising load, it will tend to rotate the pads 56 and 58 under the pads 62 and 64 affixed to arm 60. Inertia will tend to keep arm 62 from rotating. Therefore pads 56 and 58 will slide under pads 64 and 62 causing arm 60 to be pushed away from the surface of ratchet 12, compressing spring 68.

Stop posts 76 and 78 are positioned slightly above the plane of rotating arm 60 with one end affixed to the stationary containment and support case. As speed increases and rotating arm 60 moves farther away from ratchet surface 12 until it will contacts posts 76 and 78, which will stop all rotation of the ratchet and attached spool. When rotation is stopped, the pressure of spring 68 on arm 60 will cause it to slide down pads 56 and 58 and return arm 60 to rest against locating pins 72 and 74. The tension of spring 68, the pad angles and distance above the plane of posts 76 and 78 determines the maximum rotational speed the spool can achieve and hence the rate of rise of the load.

Alternate Centrifugal Brake

Figure 5:
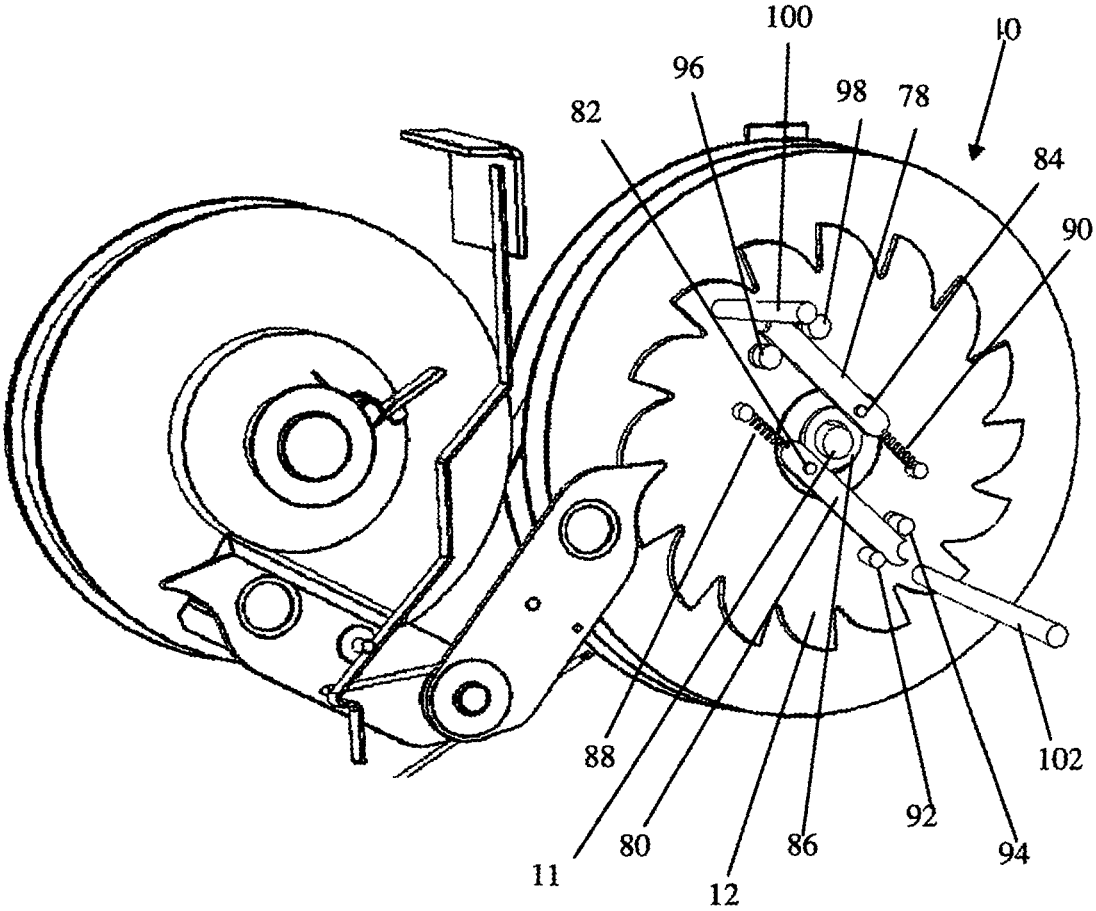

An alternative method to achieve a centrifugal brake to prevent too rapid an ascent of the load can be achieved as shown in FIG. 5. Two arms 78 and 80 are attached by pivot points 82 and 84 to a pivot 80, which rotates about axle 11. These are mounted about the disc of the ratchet 12 on storage spool 40. The arms 78 and 80 are attached to springs 88 and 90 at one end. The other end is guided between two posts 92 and 94 and 96 and 98. As ratchet 12 rotates with the loads ascent, the arms 78 and 80 will tend to extend due to centrifugal force. The springs 88 and 90 will resist this extension. As the speed increases the centrifugal force on arms 78 and 80 will exceed the spring force 88 and 90 and cause their ends to extend past posts 100 and 102, which will stop the ratchet 12 and cable spool 40 from rotating further. When the and cable spool 40 stop rotating the centrifugal force on arms 78 and 80 will stop and the arms will retract. The choice of the spring force of springs 88 and 90 determines the rotational speed at which the arms 78 and 80 engage posts 100 and 102, thereby limiting the maximum speed at which the load can ascend. Gravity will also affect the arms tending to pull one toward the center of rotation while the other is pulled away. This must be prevented or the force on arms 78 and 80 will be asymmetrical as the ratchet 12 rotates. Pivot 86 is used to cancel the affect of gravity. By attaching the arms 78 and 80 via pivot points 82 and 84 to the pivot 86, which rotates freely about axle 11, the gravitational force is cancelled out. As gravity tends to pull one arm, for example arm 78, toward the center, the other arm 80 will be pulled away from the center causing the arm extension to be asymmetric. However tendency is cancelled his is prevented by the pivot 86. Because the arms 78 and 80 are connected to pivot 86, as gravity pull arm 78 toward the center its connection to arm 80 via pivot 86 will cause the other arm 80 to also be pulled toward the center. The opposite arm 80 tending to be pulled away from the center by gravity, will also via its attachment to pivot 86 cause the opposite arm 78 to be pulled away from the center by an equal amount, hence all gravitational forces are cancelled out and the arms only extend under the influence of centrifugal rotational force.

Bicycle Attachment Devices

Figure 6:
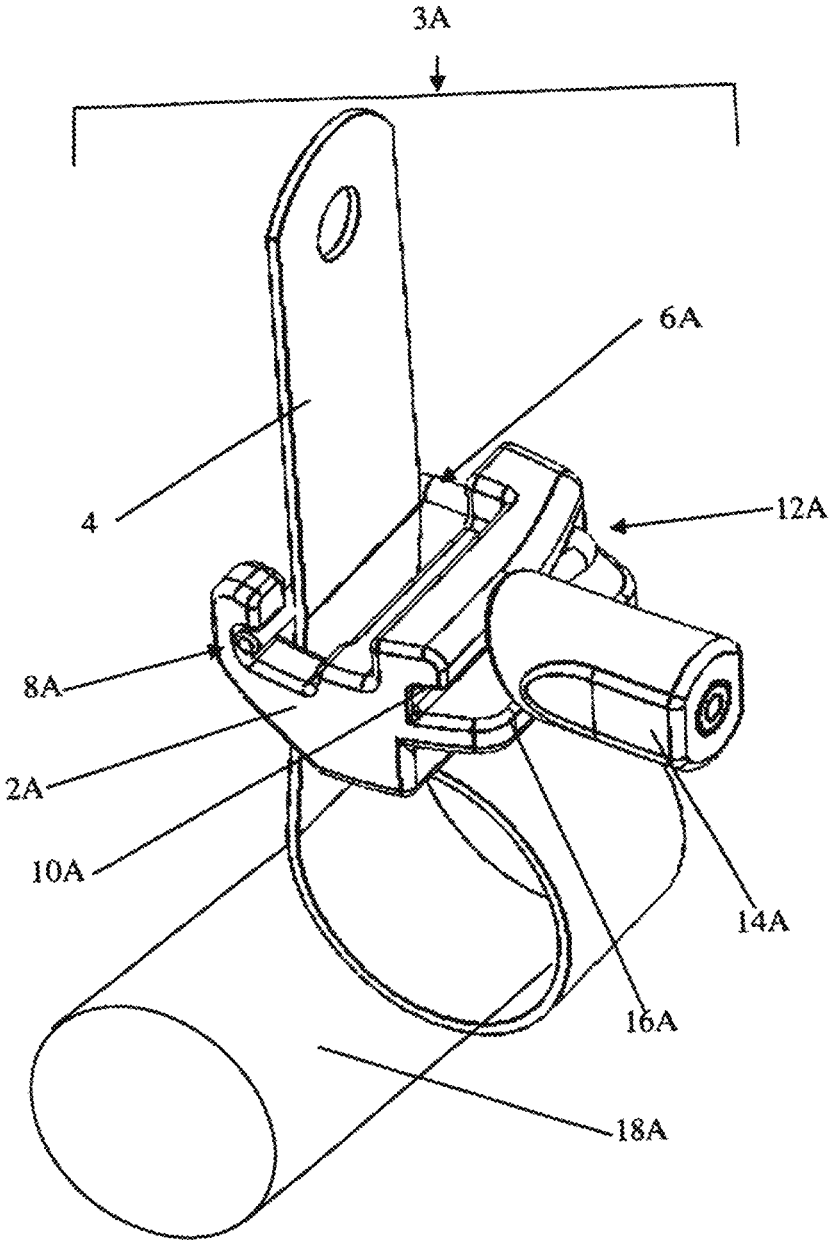
FIG. 6 shows another preferred embodiment of the present invention to securely hold a bicycle while being lifted by the device.

Loads may be attached to the lifting cable shown in FIG. 2. through a variety of means including a "J" shaped hook affixed to the lift cable 4. Bicycles provide a unique challenge to attach as they have a large variety of shapes and angles of their cross bars. In addition modern bikes are very expensive with some costing upwards of $10,000 and composed of materials ranging from bamboo to carbon fiber. The attachment device must accommodate this wide range to hold it securely, while not causing any damage. In particular the load attachment device must hold the bicycle along its cross bar which may be angled significantly without sliding along it. The load attachment device 3 in FIG. 1 secures the load (bicycle) to the device for lifting in a manner which protects the bicycle from scratching or marring while holding it securely for the large variety of bicycle cross bar shapes and sizes. A preferred device for accomplishing this is described. The bicycle attachment device 3A shown in FIG. 6 operates as follows. A reinforced rubber coated strap 4A, wraps around the bicycle frame member 18. One end is attached to the load cable 4A shown in FIG. 2. The other end is affixed to a clamping mechanism base 2A shown in FIG. 6. In operation the attachment device strap 4A is wrapped around the bicycle cross bar frame member 18. A gate rod 6A closes around the strap 4A and traps it between the base 2A and latching notch 8A. The rear portion of the gate rod 6A goes under lip 16A. When a bicycle is held in the strap 4A, the strap will self tighten around the bicycle due to its weight, as it is raised. The gate rod 6A is held by a notch 8A and under lip 6A by the forward force of the strap 4A pressing against gate rod 6A away from base 2A, due to the weight of the bicycle tensioning strap 4A. The gate rod is shaped to pass through a hole 12A in base 2A, and acts as a hinge. It is further shaped to go under the lip 16A and to a handle 14A. In this condition the bicycle can be raised by the lift cable 4 of FIG. 2. To remove the bicycle from the bicycle attachment device 3A, the bicycle is lowered to the floor as previously described One end of the bicycle is slightly raised, by the user, to take tension off the bicycle attachment device strap 4A allowing the strap 4A to be slightly loose. The handle 14A is free to rotate about gate rod 6A. It is affixed in a manner which prevents it from sliding away from the base 2A on gate rod 6A. As handle 14A is twisted clockwise it will cause gate rod 6A to be pulled to the right out of notch 8A and out from under lip 16A as its angled edge rides along lip 16A. As gate rod 6A to comes out of notch 8A and out from under lip 16A, The gate rod using handle 14A is rotated approximately 90 degrees about hole 12A, through base 2A. As it rotates it will release strap 4A from behind gate rod 6A. This is the open position. With the strap 4A free it is unwrapped from the bicycle frame member 18A, freeing the bicycle for use. To reattach the bicycle to the bicycle attachment device, the strap 4A is wrapped around the bicycle frame member 18A, with the gate in the open position. Using the handle 14A, the gate rod 6A is rotated, counter clockwise about hole 12A, in a manner such that the strap 4A is captured between the gate rod 6A and the base 2A. As the gate rod 6A is rotated counter clockwise its edge will ride along the angle of lip 10A. This will cause the gate rod 6A to pull the strap 4A toward the base 2A. As gate rod 4A continues to rotate counterclockwise it moves to the right until it is behind lip 10A and contacts lip 16A, where its rotation will be stopped. As the weight of the bike is allowed to tension strap 4A, it will pull gate rod 6A under lip 16A and into notch 8A. This will prevent the gate rod 6A from rotating further. With strap 4A trapped between gate rod 6A and base 2A and rod 6A is in notch 8A, constitutes the attachment device closed and locked position, ready for lifting a bicycle. The weight of the bicycle self tightens strap 4 around the bike frame member 18A. The strap material is chosen to provide a non slip, non scratching, secure attachment, which conforms to most size and shapes of bicycle frames.

Horizontal Bicycle Storage

Figure 7:
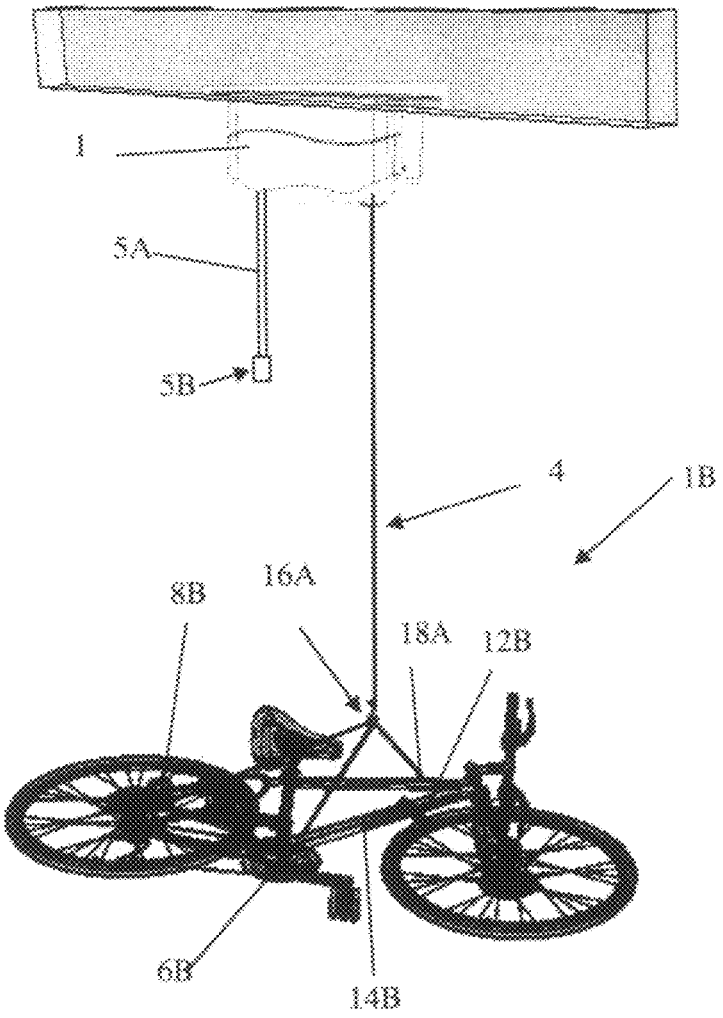
FIG. 7 shows another preferred embodiment of the present invention, which allows a bicycle to be stored horizontally.

To provide additional headroom for the storage of a bicycle when it is in its raised position, the bicycle may be attached to an alternative mooring apparatus, which allows the bicycle to be stored horizontally. The horizontal storage apparatus provides three mooring cables forming a harness 1B, as shown in FIG. 7. One end of each mooring cable is attached to the lift cable 4. The other ends are attached to brackets affixed to points on the bicycle. The brackets can be either added brackets affixed to the bicycle frame or it may consist of normal bicycle parts, such as, the bracket which holds the derailleur, which have been replaced with brackets with an additional attachment point for the mooring lines of the harness. Two of the mooring lines of the harness are attached to two fixed brackets, which are mounted to the bicycle in the appropriate positions, as described latter and the third mooring line may use the bicycle load attachment device shown in FIG. 6 or attach to a third a fixed attachment point affixed to the bicycle frame cross member 18B. The three attachment locations are; one at the pedal crank area 6B, one at the rear frame area 8B, in proximity to the rear axle, and one on the bicycle cross bar 18B, as shown in FIG. 7. The attachment points are chosen such that when a lifting force is applied by the lifting cable 4 attached to the harness, the bicycle will be lifted in a nearly horizontal orientation. The attachment points are positioned such that, as the bicycle user prepares to raise the bicycle, it is allowed to tilt to a near horizontal position determined by the harness attachment points and the length of each of its mooring cables. The attachment points and mooring cable lengths are adjusted during initial set up such that when the mooring lines are tensioned by the weight of the bicycle they position the bicycle with a slight tilt toward the rear of the bicycle and toward the lower edge of the wheels, such that it remains balanced stably between the three support attachment points. To prevent the front wheel from rotating about the steering axis when it is lifted in the near horizontal orientation, an adjustable strap 12B is affixed between the front wheel and the frame member 14B. It holds the front bicycle wheel such that it is maintained in approximately the same plane as the frame, during lifting and storage. The strap 12B may be similarly attached for a bicycle to be stored in the vertical orientation to prevent the front wheel from turning during lifting and storage and thereby provide a more compact profile for storage. The bicycle is raised in this near horizontal orientation. Loops in the cable ends, at the end of each mooring line attach to the fixed brackets on the bicycle. The brackets, which are affixed to the bicycle, are suitably covered in a soft material to prevent scratching or other damage to the bicycle. In operation after attaching the lift harness to the three points, the bicycle is allowed to lean into a near horizontal position supported by the harness. With the bicycle supported by the harness the user pulls the release cord 6 as previously described to start the lift sequence, then applies a momentary downward force on the load to cause the pawl 10 of FIG. 2 to disengage, which allows the bicycle to rise to the desired storage height, while in a near horizontal position.

Storing the bike in this near horizontal position provides greater space between it and the floor, thereby providing greater headroom, than in the case where the bicycle is held vertically. This feature is a very useful feature in a low ceiling area. The WiFi controlled release mechanism of FIG. 3 may also be used in the horizontal bike lift configuration.

Alternate Mechanism for Bicycle Storage

Figure 9:
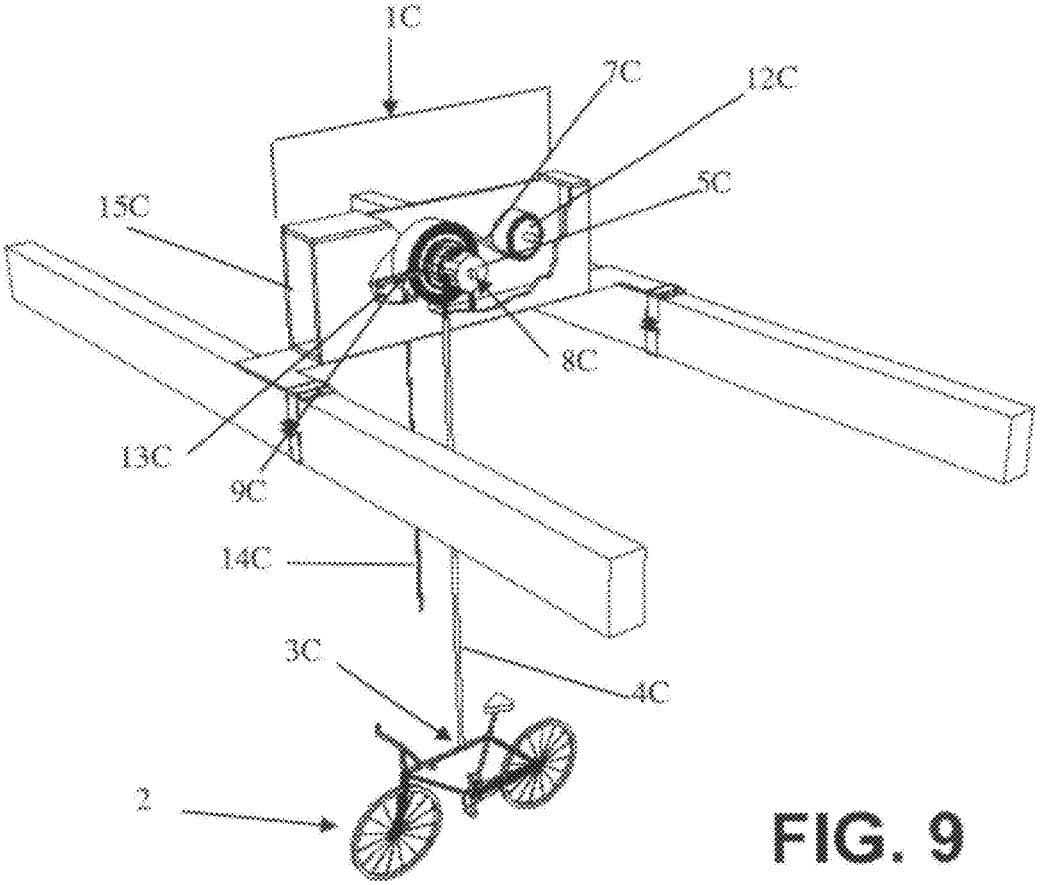
FIG. 9-10 show an alternate mechanism embodiment for the present invention.

FIG. 9 shows an alternate mechanism for a bicycle storage device, which allows a bicycle to be lifted by a constant torque spring and pulley mechanism, from its standing position on the ground to a position at the top of the lifting device's travel for storage. A bicycle 2 or other load is attached by a load hook 3C, as shown in FIG. 9 to a lift cable 4C suspended by the device's cable pulley 5C, which is attached to containment box 15 through a shaft 8C, shown in FIG. 10A constant torque spring 7C supplies a force slightly greater than the weight of the object load (bicycle), such that the load object will rise until the maximum lift height is reached or the object reaches the ceiling. A preferred constant torque spring is available from Vulcan Springs, Inc. with offices in Telford, Pa. The object load (bicycle) is lowered by manually applying a small amount of downward force, by pulling downward on the object attached to the load hook 3C of FIG. 9. As the object load 2 (a bicycle) of FIG. 9 is lowered the pawl 9C and ratchet 10C mechanism, shown in FIG. 10, allow it to descend by rotating (in this example a counter clockwise rotation) but when the downward pull is stopped the load object will tend to rise due to the torque applied to it by the constant torque spring 7C by turning the cable pulley 5C in a clockwise direction this will cause the pawl 9C to engage the ratchet 10C and prevent the cable pulley from turning and the load from rising. The pawl 9C is positioned such that an arc from its pivot position with a radius equal to the distance from the pivot to the pawl 10C apex will intersect the circumference of the ratchet teeth, root circle. The position at which the pawl 9 stops the rotation of the ratchet 10C is where the lower intersection of the two circles occurs. This action allows the load to be stopped at any point in its travel, when the downward force applied by the user is stopped: With the pawl 9C engaged into the ratchet 10C, the object load, such as a bicycle, can be removed from the load hook 3C of FIG. 9. The load hook 3C remains at whatever height above the floor it was positioned at.

Figure 10:
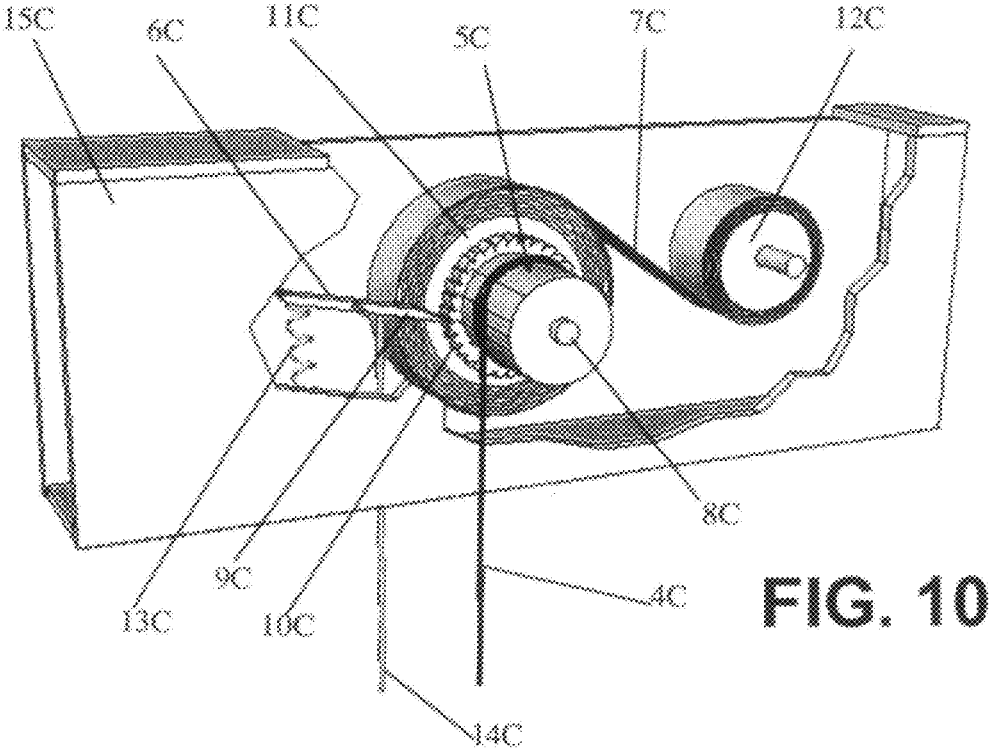
Figure 11:
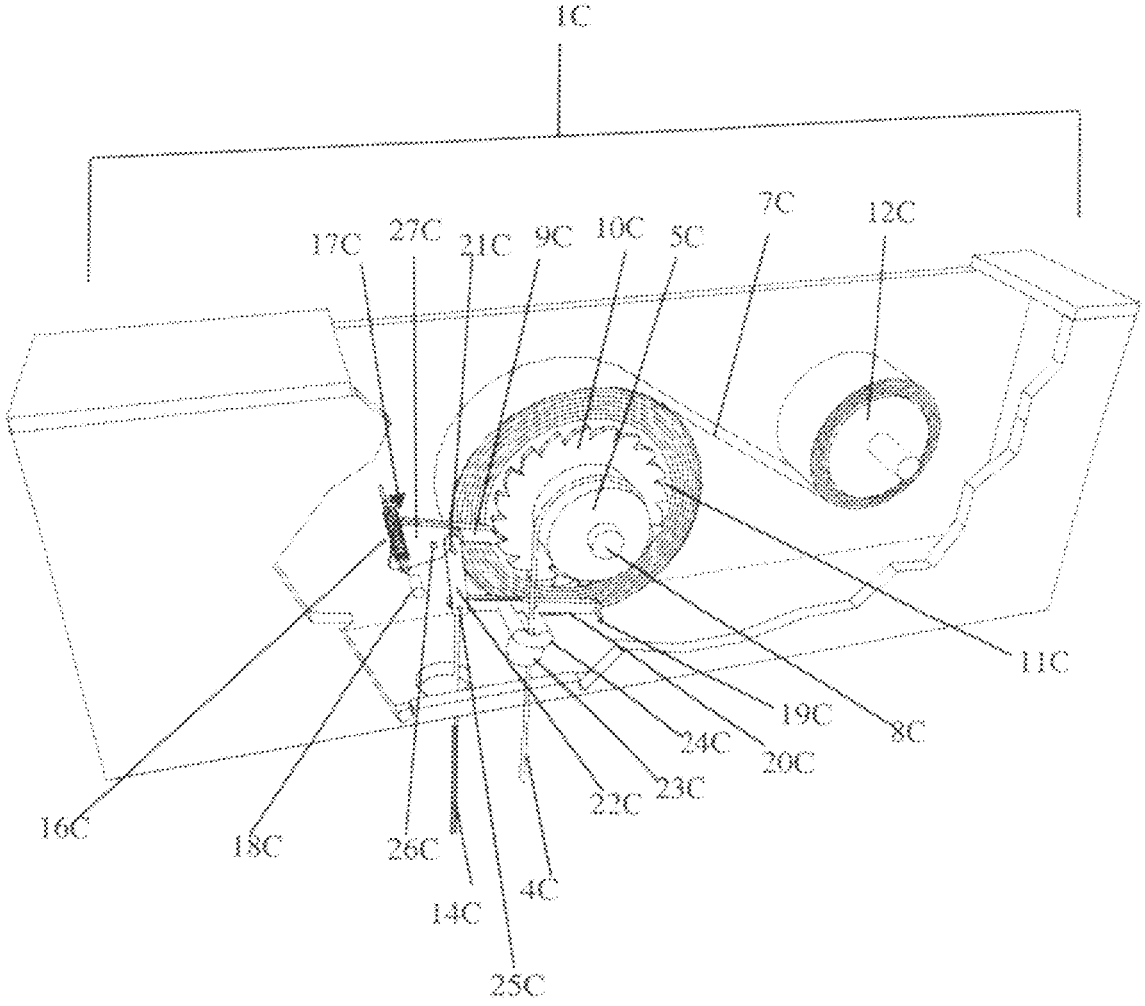
FIG. 11-12 show an alternate mechanism of the present invention for causing the ascent of the load without continuously pulling he release cord during the loads ascent.

Lift cable 4C is wound around the cable pulley 5C, as shown in FIG. 10, to which the lift cable 4C is attached and connected by a shaft to the output spool 11C of the constant torque spring 7C. The constant torque spring mechanism 1 shown in FIG. 11 is comprised of a support structure 15C and a constant torque spring 7C, which is wound around two spools. The output spool 11C and the storage spool 12C, as shown in FIG. 11, which are supported by their respective axle shafts. A portion of the constant torque spring is coiled about the output spool 11C and a portion about the storage spool 12C in the reverse rotation, as shown in FIG. 2. This reversal of the winding from the output spool 11C to the storage spool 12C creates a nearly constant torque on the output spool 11C (+/−10%), which is transferred to the cable pulley 5C by the connecting axle 8C connected to the cable pulley 5C. The torque transferred to the cable pulley 5C generates a force which tends to wind the lift cable 4C about the cable pulley and thereby lift the load of the attached bicycle or other object, within the lifting limits of the torque, which is supplied by the constant torque spring 7C. The spring is designed such that the torque it generates in combination with the size of the output spool produces a force, which is slightly greater than the weight of the intended load (bicycle for example) to be lifted. The maximum lifting capability is determined by the proper choice of the spring parameters, spool diameters and the cable pulley's diameter. For a given constant torque spring, the lifting torque and thereby the load lifting capability of the device can be adjusted to suit the intended load by adjusting the diameter of the cable pulley 5C. This can be accomplished in a variety of ways, for example by replacing the spool with a suitable diameter for the load, by adding or removing a hollow cylindrical sleeve to the base cable pulley 5C to increase its diameter, or by winding a material about the spool upon which the lifting cable rides on top of, thereby increasing the effective diameter as experienced by the lifting cable 4C. The spring mechanism provides a nearly constant torque independent of the number of turns on the output and storage spools. This creates a nearly constant force on the lift cable, which is always tending to lift the object load. To lower the load a downward force is applied by the user which overcomes the constant torque spring force applied to the cable pulley 5C such that it unwinds the lift cable 4C, causing the load to descend. This will wind further turns of the constant torque spring 7C onto the output spool 11C as the load is lowered. In normal operation the constant torque spring 7C is coiled about the storage spool 12C with only a few turns about the output spool 11C. As the load is lowered, from its uppermost position, it winds an increasing portion of the constant torque spring 7C about the output spool 11C, which supplies torque to the cable pulley 5C and thereby provides a force to resist the weight of the object load, attached to the lift cable 4C, in affect counter balancing it. During lowering of the load, the pawl 9C, is not engaged into the ratchet 10C, attached to the cable pulley 5C but rides on top of the teeth of ratchet 10C. When the load reaches the desired height and the downward force applied by the user is released, the pawl 9C will engage a tooth of the ratchet 10C, as it tries to rotate clockwise, preventing it from turning any further and thereby any upward travel of the lift cable 4C. This allows the load to be lowered to any desired height and removed from the load hook 3C, shown in FIG. 9, at any position along its travel.

To raise the load, the pawl 9C is disengaged from its associated ratchet 10C by pulling a release cord 14C attached to it and simultaneously pushing down on the load. The action of pulling the release cord 14C, puts counter clockwise tension on the pawl 9C, but it will remain trapped in a tooth of ratchet 10C unable to rotate clockwise. Pushing down on the load, releases the tension on the pawl 9C, due to the constant torque spring 7C. As the cable pulley 11C rotates counterclockwise, the ratchet 10C attached to it rotates with it. As the ratchet turns by one tooth counterclockwise, the pawl 9C will come free of the teeth of ratchet 10C. With the pawl 9C free of the ratchet 10C the cable pulley 5C is free to rotate clockwise as long as the release cord is held to keep pawl 9C disengaged from the ratchet 14C. This disengaging pawl 9C allows the ratchet 10 attached to the output spool 11C to rotate clockwise, due to the force applied by the constant torque spring 7C, which causes the load cable 4C to be wound around the cable pulley 5C, in turn causing the load to rise. When the load is not attached on the load hook 3C the release of the pawl 9C is prevented by the force of the torque, which is trying to turn the ratchet 10C clockwise, for raising a load and thereby holding the pawl 9C against a tooth of the ratchet 10C, preventing it, the cable pulley 5C and output spool 11C from turning in a clockwise direction. This action provides a safety factor to the operation, which requires both the release cable to be pulled and the load to be pushed and or pulled downward simultaneously, to initiate the ascent. When a load is placed on the load hook 3C it counter balances the force, on the pawl 9C, which is tending to keep it engaged into a ratchet 10C tooth, thereby allowing the pawl 9C to be easily disengaged, by pivoting downward, about pawl hinge pin 26C, when the release cord 14C is pulled and the load is lowered by the amount of one tooth rotation of the ratchet 14C.

Alternate Release Mechanism

Figure 12:
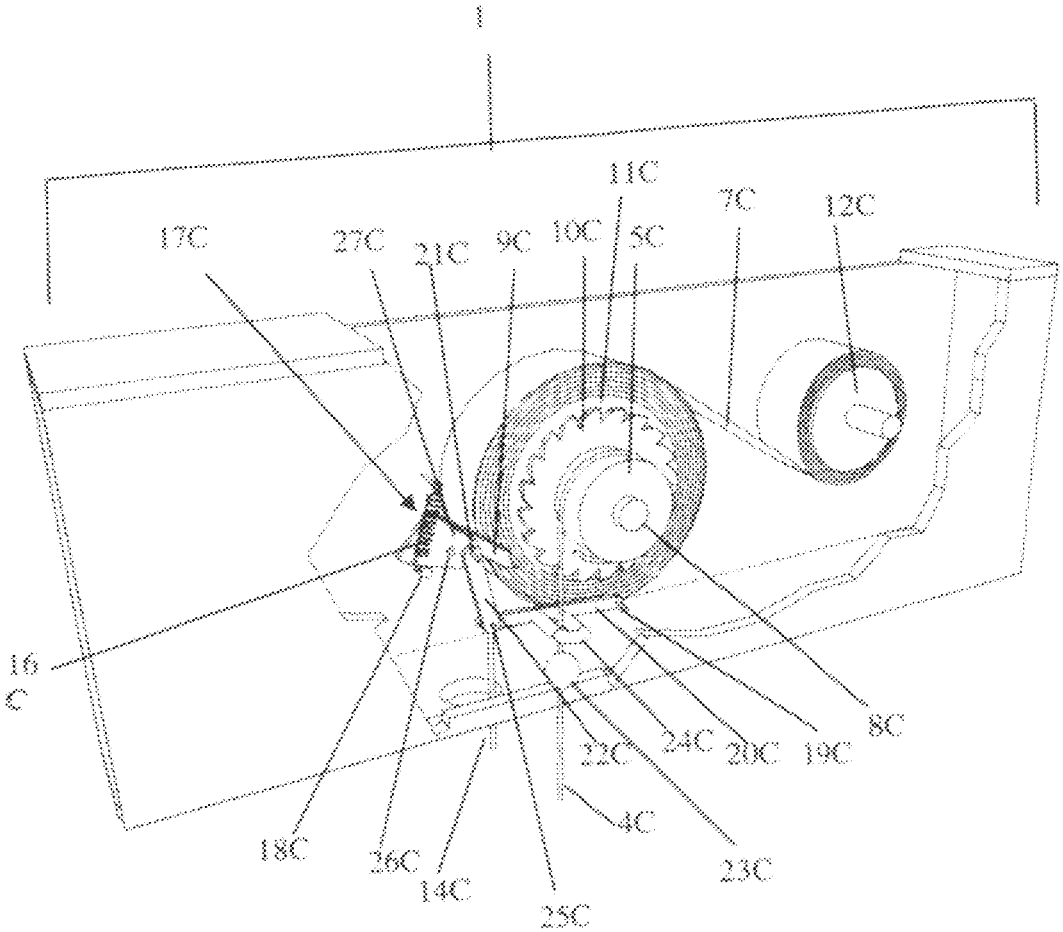

In the above described release mechanism, the release cord must be pulled down during the entire time the load is being raised, in order to keep the pawl 9C from re-engaging the teeth of ratchet 10C. This is convenient for stopping the load at any point during its ascension. However it may be inconvenient for some applications to continuously pull the release cord 14C as the load is raised. Therefore, an alternate release mechanism is described in FIG. 11. In this mechanism when the release cord 14 is pulled downward it rotates the cam 27C, which is in its up position as shown in FIG. 11, about hinge pin 26C, overcoming the spring force of spring 17C, which is tending to rotate the cam 27C counter clockwise. The cam 27C rotates clockwise, until its bottom edge contacts the stop pin 18C. The arm 22C and the release lever 20C are also rotated about hinge pins 19C, 21C, and 25. The lower end of the cam spring 17C, will rotate about hinge pin 26C. As its lower end rotates clockwise from its position shown in FIG. 11 to the position shown in FIG. 12, the centerline of the spring moves from the right of the hinge pin 16C about which it pivots, to the left side of the hinge pin 26C. Thereby changing the force applied on the cam 27C, from tending to rotate it counter clockwise to a force, which tends to rotate it clockwise. Therefore, when the downward pull on the release cord 14C is stopped, the cam 27C, arm 22C and release lever 20C will all remain in their downward rotated positions, as shown in FIG. 12. The pawl 9C remains engaged in the ratchet 10C due to the clockwise rotational force of the constant torque spring 7C of FIG. 11, tending to rotate the ratchet clockwise, as it overcomes the counterclockwise force on the cable pulley 5C and ratchet 10C exerted by the load. When the load on the load hook 3C of FIG. 10 is lowered slightly, by an amount equal to one tooth rotation of the ratchet 10C, the pawl 9C will disengage from the ratchet 10C and rotate downward about hinge pin 26C until its lower edge contacts stop pin 26C, stopping its further rotation but clear of the teeth of ratchet 10C. The pawl 9C remains disengaged from the ratchet 10C and the load can rise without the release cord 14C being continuously pulled. When the load reaches its raised storage position a sphere 23C, shown in FIG. 11 affixed in the appropriate position on the lift cable 4C, at a position above the load hook 3C will contact the release loop 24C on the release lever 20C, causing it to rotate clockwise about hinge pin 19C. This will push arm 22C, upward causing cam 27C to rotate counterclockwise, thereby rotating pawl 9C counterclockwise until it re-engages a tooth of the ratchet 10C. The spring 17C will also have had its lower end rotated counterclockwise, causing the force it applies to the cam 27C to return to the state where it applies a counterclockwise force to the cam 27C. This rotates the pawl 9C against the teeth of ratchet 10C, as shown in FIG. 11. With the pawl re-engaged in the ratchet the load is stopped from rising further and the load is held in the raised storage position. Pulling down on the load will cause the tip of the pawl 9C to rotate clockwise and deflect the cam clockwise, as well, due to its resting on hinge pin 26C. However the deflection to allow the tip of pawl 9C to ride on top of the teeth of ratchet 10C, as the load is lowered, is not sufficient to cause the lower end of spring 17C to pivot far enough to change the direction of the force it applies in a counterclockwise direction to cam 27C to clockwise.

Variations

The present invention is described above in terms of specific embodiments. However persons skilled in this art of storage devices will recognize that many alterations, additions and embodiments are possible utilizing the novel concepts described above with respect to the specific embodiments. Therefore, the scope of the present invention should be determined by the appended claims and their legal equivalents rather than the examples given.

What is claimed is:

1. An overhead storage device having a lifting range, for lifting and storing a bicycle above floor level, said device comprising:

A) a support case,

B) a cable pulley,

C) a constant torque spring mechanism attached to the cable pulley comprising:

1) an output spool and a storage spool, 2) a single constant torque spring unit wrapped partially around the output spool and partially around the storage spool, said output spool being rotatably connected by a common shaft to the cable pulley, said single constant torque spring being and adapted to-apply an approximately constant, within +/−10 percent, torque to the cable pulley, D) a lift cable partially wound around the cable pulley and having an attachment mechanism at one end of the lift cable; said attachment mechanism comprising:

1) a clamping mechanism defining a clamping mechanism base and a latching notch, 2) a reinforced rubber coated strap adapted to be wrapped around a bicycle cross bar frame member, 3) a gate rod rotatably attached at one end to the clamping mechanism base with one end adapted to fit in the latching notch after the rubber coated strap has been wrapped around the bicycle cross bar frame member so as to trap the rubber coated strap within the clamping mechanism so that the strap will self-tighten due to the weight of the bicycle frame member when the bicycle is raised and so that the gate rod will be held within the notch by the force of the reinforced rubber coated strap pressing against the gate rod, E) a locking mechanism; comprising:

1) a ratchet unit rotatably attached to the output spool, 2) a rotatable release arm mounted on an axle, 3) a tension spring attached to the rotatable release arm adapted to apply clockwise and counterclockwise tension to the release arm depending on positions of the rotatable release arm, 4) a release cord attached to the rotatable release arm, 5) a pawl with a latch pin attached to the pawl, said pawl being adapted to rotate in and out of the ratchet unit, 6) a flat latch spring defining a free end and a fixed end fixed with respect to the support case, said flat latch spring also defining a step, the step defining a latch point under which the latch pin may be caught to prevent the latch pin, when rotating, from rotating further, 7) a first torque spring attached to the release arm and configured to rotate the pawl clockwise and a second torque spring configured to rotate the pawl counter-clockwise, wherein the locking mechanism is adapted to permit the attachment mechanism and an attached bicycle to be lowered and locked at any desired position within the lifting range of the device, and wherein the constant torque applied to the cable pulley by the constant torque spring continuously causes the cable, unless the cable is restrained, to be further wound on the cable pulley, and wherein the locking mechanism is adapted to restrain rotation of the cable pulley the output spool and the storage spool unless:

1) the release cord has been pulled downward disengaging the pawl from the ratchet unit when a downward force is temporarily applied to the cable and 2) a downward force, large enough to overcome the constant torque applied to the cable pulley by the constant torque spring, is temporarily applied to the cable, wherein the bicycle may be raised to an overhead position by upward forces provided by the constant torque spring by a user momentarily applying a downward force on the lift cable after pulling down on the release cord to disengage the pawl from the ratchet unit, and wherein the bicycle may be lowered from the overhead position to a bicycle removal position by the user applying a downward force on the bicycle overcoming an upward force on the bicycle provided by the constant torque spring.

2. The overhead storage device as in claim 1, further comprising a centrifugal clutch for stopping rotation of said cable pulley during rapid acceleration of said cable pulley.

3. An overhead storage device as in claim 1, whereas a release cord is in the form of a loop and the loop is used as a means of raising the lift cable when the lift cable is not in use to lift the bicycle.

4. The overhead storage device as in claim 1, wherein said bicycle is horizontally attached to said cable.

* * * * *